US005799910A

United States Patent [19]

Dexter

[11] Patent Number: 5,799,910

[45] Date of Patent: Sep. 1, 1998

[54] TOOTHPASTE TUBE HOLDER

[76] Inventor: Fred E. Dexter, Box 55, 268 Lake Shore Dr., Boulder City, Nev. 89005

[21] Appl. No.: 550,951

[22] Filed: Oct. 31, 1995

Related U.S. Application Data

[63] Continuation-in-part of Ser. No. 189,280, Feb. 1, 1994.

[51] Int. Cl.[6] ..... B65D 35/56

[52] U.S. Cl. ..... 248/109; 211/65; 211/71; 248/111; 248/314

[58] Field of Search ..... 248/109, 108, 248/111, 314; 211/65, 71

[56] References Cited

U.S. PATENT DOCUMENTS

| | | | |
|---|---|---|---|
| 1,811,222 | 6/1931 | Wolf | 248/109 |
| 2,099,906 | 11/1937 | Reese et al. | 248/109 X |
| 2,415,447 | 2/1947 | Stanton | 211/65 X |
| 2,495,866 | 1/1950 | Perry et al. | 211/70.6 X |
| 2,500,905 | 3/1950 | Raykoff | 211/65 |
| 3,189,310 | 6/1965 | Trueson | 248/314 |
| 3,233,743 | 2/1966 | Di Tirro | 211/65 |
| 4,009,818 | 3/1977 | Rogers | 248/314 X |
| 4,211,750 | 7/1980 | Gillespie | 211/65 X |
| 4,219,035 | 8/1980 | Deconinck | 211/65 |
| 5,353,926 | 10/1994 | Yeh | 248/346.11 X |

FOREIGN PATENT DOCUMENTS

| | | | |
|---|---|---|---|
| 1377906 | 9/1964 | France | 248/109 |

*Primary Examiner*—Ramon O. Ramirez
*Assistant Examiner*—Derek J. Berger
*Attorney, Agent, or Firm*—Schmeiser, Olsen & Watts

[57] ABSTRACT

A toothpaste tube and toothbrush holder is disclosed for holding various sized and shaped toothpaste tubes. The toothpaste tube holder includes slots for ease of access of the toothpaste tube and for providing a wedging action for securely holding the toothpaste tube in a rolled-up position when not in use. The holder also provides a plurality of recessed shelves for holding other types of toothpaste containers. Finally, the device comprises an enclosed cavity for holding toothbrushes, the cavity being accessible from a removable base tray.

7 Claims, 4 Drawing Sheets

TOOTHPASTE TUBE HOLDER

CROSS REFERENCE TO RELATED APPLICATION

This application is a Continuation-In-Part of co-pending application entitled TOOTHPASTE TUBE HOLDER, Ser. No. 08/189,280, filed on Feb. 1, 1994, and allowed Nov. 10, 1994.

BACKGROUND OF THE INVENTION

1. Field of the Invention

This invention relates generally to a holder for collapsible tubes. In particular, this invention relates to a holder for a toothpaste container and toothbrushes.

2. Description of Related Art

The prior art discloses collapsible tube or toothpaste tube holders having various features for holding the tube when not in use. A difficulty with these prior art devices is that they do not compensate for holding the tube in a collapsed condition. As the material, such as toothpaste, is squeezed from the collapsible tube, the bottom of the tube is rolled-up. If the holder does not have inner side walls to conform to a rolled-up tube, the tube unravels when it is returned to the holder.

Furthermore, prior art devices do not provide for the holding of toothpaste containers that come in various shapes and sizes.

Sussman, U.S. Pat. No. D293,532 discloses a combined toothbrush tumbler and toothpaste holder. The portion of the holder for holding the toothpaste in this prior art reference has inner sidewalls which do not compensate for a toothpaste tube which has been rolled. A rolled tube would fit loosely within the holder and thus would unravel. Additionally, in a rolled condition, the tube may only be accessed through a top opening which does not provide convenient access for the user.

Goldenberg, U.S. Pat. No. D312,546 discloses a toothpaste tube holder having a front downwardly extending slot, this tube holder has the drawback of a nonconforming inside thus allowing the tube to unravel.

U.S. Pat. No. D88,288 to Gunnison shows a collapsible tube support with a tapered receiver for holding a tube in what appears to be a sideways position. U.S. Pat. No. D225,497 to Smith shows a tapered toothpaste tube holder having an open bottom and a plurality of hooks for attachment to a vertical support such as a wall. U.S. Pat. No. 1,252,051 to Stone discloses a carton case made of a cardboard or a fiber board blank and used as an outer covering for collapsible tubes containing pastes, creams and other semi-liquids. The carton case assists in maintaining its shape due to its stiffness when exerting pressure upon the faces of the wedge. U.S. Pat. No. D256,411 discloses a tube holder having a plurality of vertically offset parallel sheets with rounded openings for toothpaste tubes or other squeezable tubes.

SUMMARY OF THE INVENTION

The present invention includes all the advantages of the prior art references while overcoming the aforesaid disadvantages. In particular, the present invention includes a collapsible tube support having interior surfaces which are adapted for holding a full toothpaste tube and also compensating for variations in size as the tube is collapsed by rolling. The present invention also is adapted for holding non-traditional shaped toothpaste holders.

More specifically, the core of the present invention includes opposing concave surfaces which conform to the sides of a full toothpaste tube. Between the outer surface of the holder and the core are a plurality of opposing slots. The slots permit the end of the tube opposite the cap to slide in and out of the holder in either a full or rolled condition. At the bottom of the slots and the core is a notch which conforms to the end of a tube in a full or rolled condition.

Another advantage of the present invention is providing a toothpaste tube which permits easy access to the user. Tapered slots in the side of the holder are provided for ease of access of a toothpaste tube (e.g., with a thumb and finger). The slots also assist in wedging the sides of the rolled toothpaste tube so that it does not become unraveled. The difficulty with the toothpaste tube unravelling is that the user must roll the tube before each use to squeeze the toothpaste therefrom.

A further advantage of the present invention is providing a passive toothpaste holder which permits the holding of various sized toothpaste containers (e.g., pump tubes). This is accomplished through the use of shelves that exist on the opposing concave surfaces of the toothpaste tube holder.

Still a further advantage of the present invention is to provide a toothpaste tube holder which also has enclosed slots for holding a plurality toothbrushes.

Still a further advantage of the present invention is to provide a toothbrush holding device that is further enhanced by having a removable bottom that allows for easy cleaning within said enclosed slots.

BRIEF DESCRIPTION OF THE DRAWINGS

The character of the invention may be best understood by reference to one of its structural forms, as illustrated by the accompanying drawings.

DETAILED DESCRIPTION OF THE PREFERRED EMBODIMENT

Figure 6:
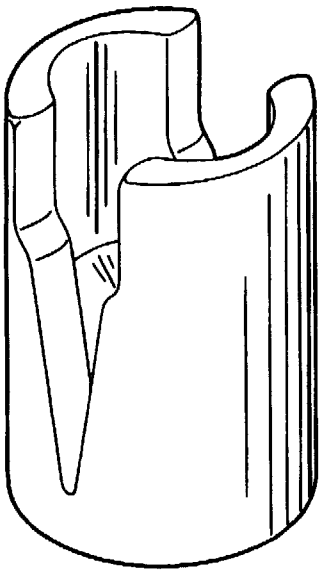
FIG. 6 is a perspective view of the toothpaste tube holder of the present invention.
Figure 1:
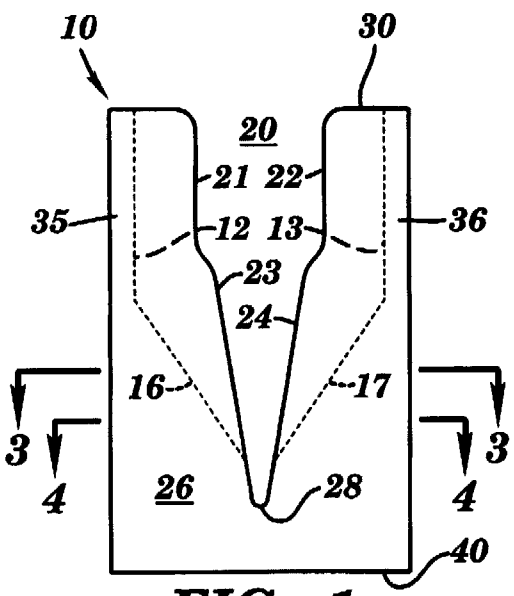
FIG. 1 is a side view of the present invention.

FIG. 1 shows a side view and FIG. 6 shows a perspective view of the toothpaste tube holder 10 of the present invention. Referring to FIG. 1, the toothpaste tube holder 10 includes an upper surface 30, an outer surface 26 and a base surface 40 for supporting the holder 10. The outer surface 26 includes a first face 35 and a second face 36. The first 35 and second 36 face are shown as having rounded convex surfaces, however other shapes, such as polygonal, abstract or fanciful, are contemplated as being within the spirit of the present invention. It is also envisioned that the holder 10 could be made of plastic, ceramic or any other suitable material.

Figure 4:
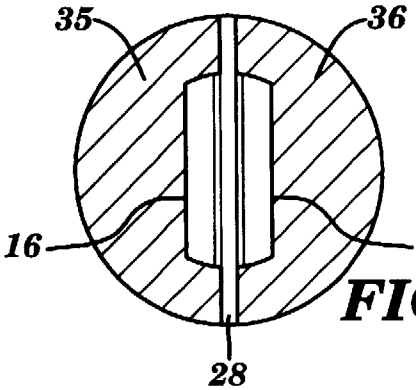
FIG. 4 is a section view taken through lines 4—4 of FIG. 1 of the present invention.
Figure 3:
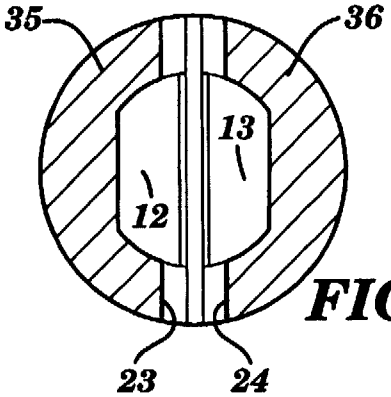
FIG. 3 is a section view taken through lines 3—3 of FIG. 1 of the present invention.
Figure 2:
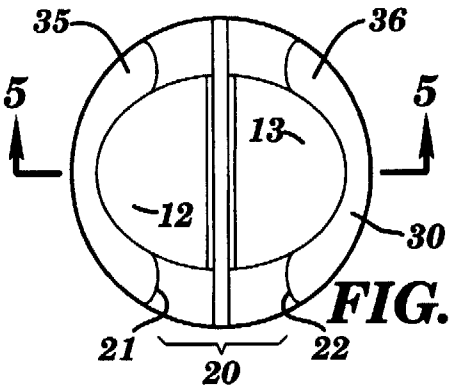
FIG. 2 is a top view of the toothpaste tube holder of the present invention.

The upper surface 30 includes a toothpaste tube receiving cavity. The cavity includes a central core having inner side walls 12, 13, 16, 17 and opposing slots 20. The central core side walls 12, 13 define opposing concave surfaces of a noncontinuous cylindrical surface having vertically parallel side walls. The concave surfaces 12, 13 are described as noncontinuous cylindrical surfaces because they are interrupted by the opposing slots 20. Positioned below the core side walls 12, 13, are downwardly converging noncontinuous cone shaped side walls 16, 17. As shown in FIGS. 2–4 a notch 28 is positioned below the cone shaped side walls 16, 17. The notch 28 extends the diameter the tube holder 10. Alternatively, notch 28 may be a flat surface between side walls 12, 13. The side walls 12, 16 are mirror images of the side walls 13, 17 and conform to a full or partially full toothpaste tube.

As shown in FIGS. 1–3 and 5–6, a slot 20 is positioned between the central core 12, 13, 16, 17 and the outer surface 26. The slot 20 includes parallel upper edges 21, 22. The surfaces are curvilinear when viewed from the top as shown in FIG. 2. The lower edges 23, 24 of the slot 20 are V-shaped or parabolic and end in notch 28.

FIG. 3 shows a cross-sectional view as taken through line 3—3 of FIG. 1. The distance between the concave inner surfaces 12, 13 of the core and the first 35 and second face 36 is constant.

FIG. 4 shows a cross-sectional view as taken through line 4—4 of FIG. 1. The cross-sectional area of the distance between 35 and 16 and between 17 and 36 varies with vertical height.

Figure 5:
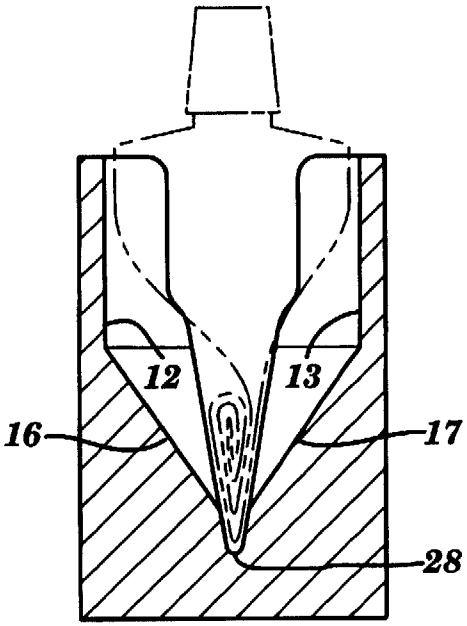
FIG. 5 is a sectional side view of the toothpaste tube holder of the present invention.

FIG. 5 is a cross-sectional view as taken through lines 5—5 in FIG. 2. As shown in phantom in FIG. 5, the V-shaped or parabolic slot 20 assists in wedging a rolled toothpaste tube 50.

Figure 7:
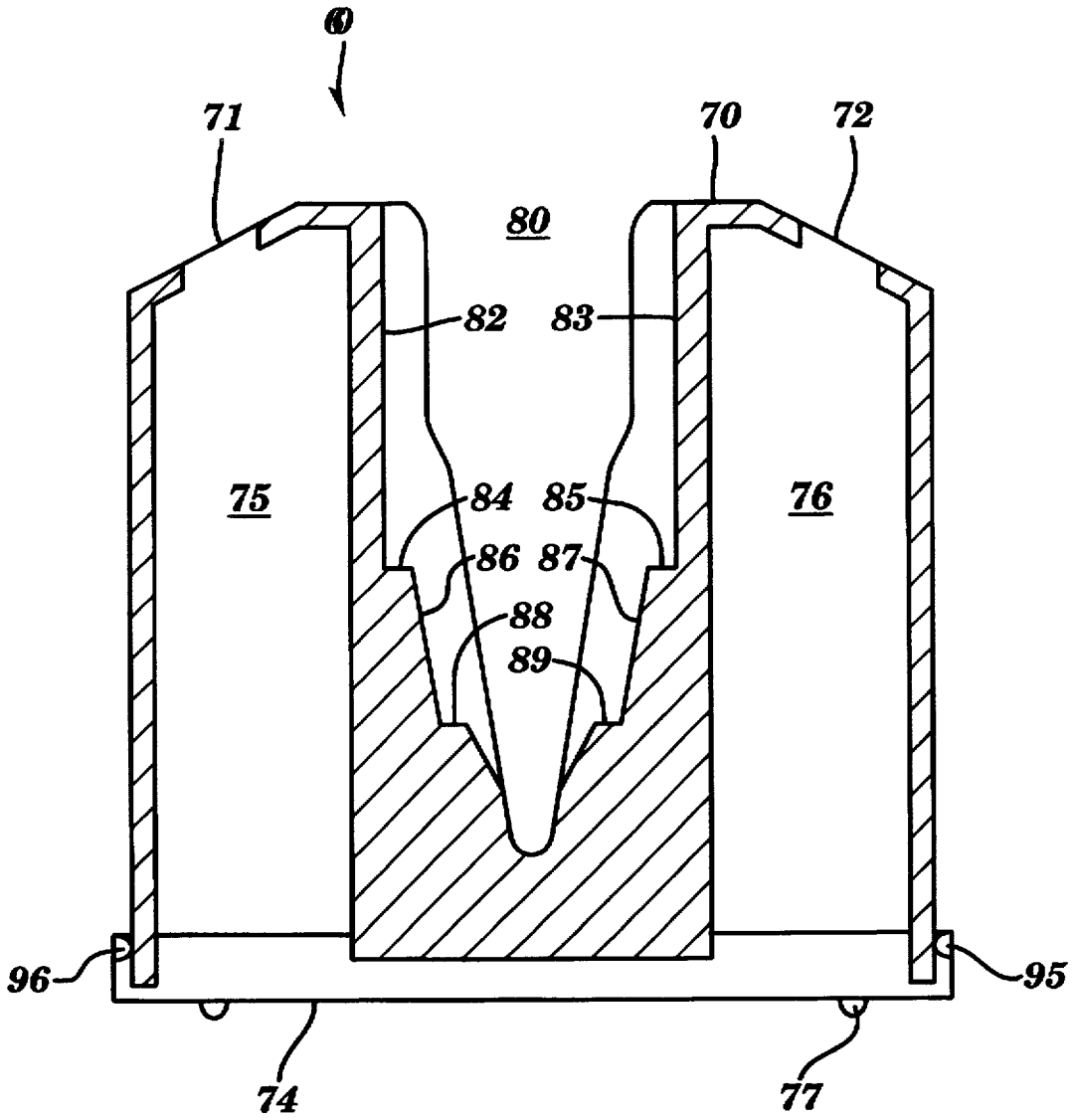
FIG. 7 is a front view of an alternate embodiment of the present invention.

Referring now to FIG. 7, an alternate embodiment of the present invention is disclosed. The tube holder 60 is similar to that shown in FIG. 1–6 with the following additional functionalities. The toothpaste tube holder 60 includes an upper surface 70 that has a plurality of receiving holes 71 and 72 for receiving and storing toothbrushes in enclosed cavities 75 and 76. Although the construction of device 60 can be such that any number of receiving holes 71 and 72 can be incorporated therein, it is envisioned that device 60 will ideally have either 4 or 6 receiving holes.

The device 60 also includes a bottom cover (or removable base) 74 which can be removed as required for cleaning and maintenance purposes. Bottom cover 74 can be any type of attachment device known in the art, such as a snap-on or a screw-on type tray or lid. Thus, a toothbrush which is stored in receiving holes 71 and 72 will rest inside cavities 75 and 76. Because drippings and the like from the toothbrushes will gather in the lower portions of cavities 75 and 76, cleaning is made relatively easy with the removal of bottom cover 74.

Figure 8:
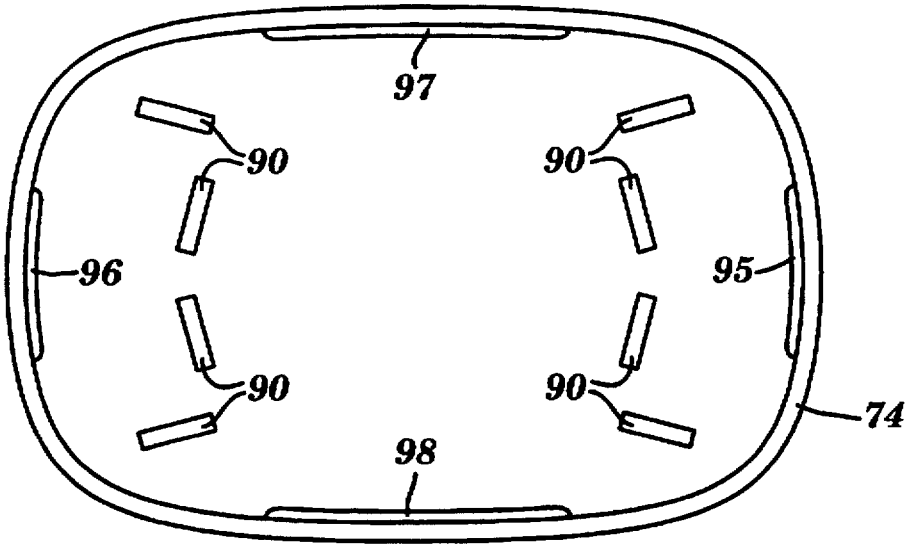
FIG. 8 is a top view of the base tray pursuant to an alternate embodiment of the present invention.

Bottom cover 74 may also include notches 95, 96, 97 and 98 (see FIGS. 7–8). The notches provide adequate resistance such that the removable base 74 is firmly held in place. It is envisioned that at least two, but preferably four notches should be employed.

In addition, the removable base 74 also includes a lip 75 that extends upward around the entire toothpaste tube holder. The lip traps any moisture in the base thereby preventing a messy counter or the like. Moisture can instead evaporate through the inserts 71 and 72.

This embodiment also includes a toothpaste tube receiving cavity 80 similar to that found in FIG.'S 1–6. The device includes core side walls 82 and 83 which have opposing concave surfaces, best described as a noncontinuous cylindrical surface having vertically parallel side walls. The core side walls 82 and 83 extend downward until they are interrupted by a first pair of shelves 84 and 85. Shelves 84 and 85 provide a means for holding non-traditional shaped toothpaste tubes, such as a cylindrical-shaped toothpaste tube stand-up type toothpaste tubes, or the like. The shelf defined by 84 and 85 can be manufactured with the specification of any popular toothpaste holding device in mind.

Positioned below shelves 84 and 85, are noncontinuous cone or tapered shaped side walls 86 and 87 which converge downward toward secondary shelves 88 and 89. Side walls 86 and 87 can be described as concave noncontinuous cylindrical surfaces. Shelves 88 and 89 perform a function similar to that of shelves 84 and 85. These shelves can provide a means for holding a toothpaste tube container which has a smaller diameter than that which would be used for shelves 84 and 85.

It should be noted that this embodiment provides the same functionality of that found in FIGS. 1–6. In other words, the side walls are still able to conform to a full or partially full traditional type toothpaste tube. In addition, it should also be noted that the above description discloses two sets of shelves 84 & 85 and 88 & 89, however, it is envisioned that any number of shelves could be employed within this device.

Figure 9:
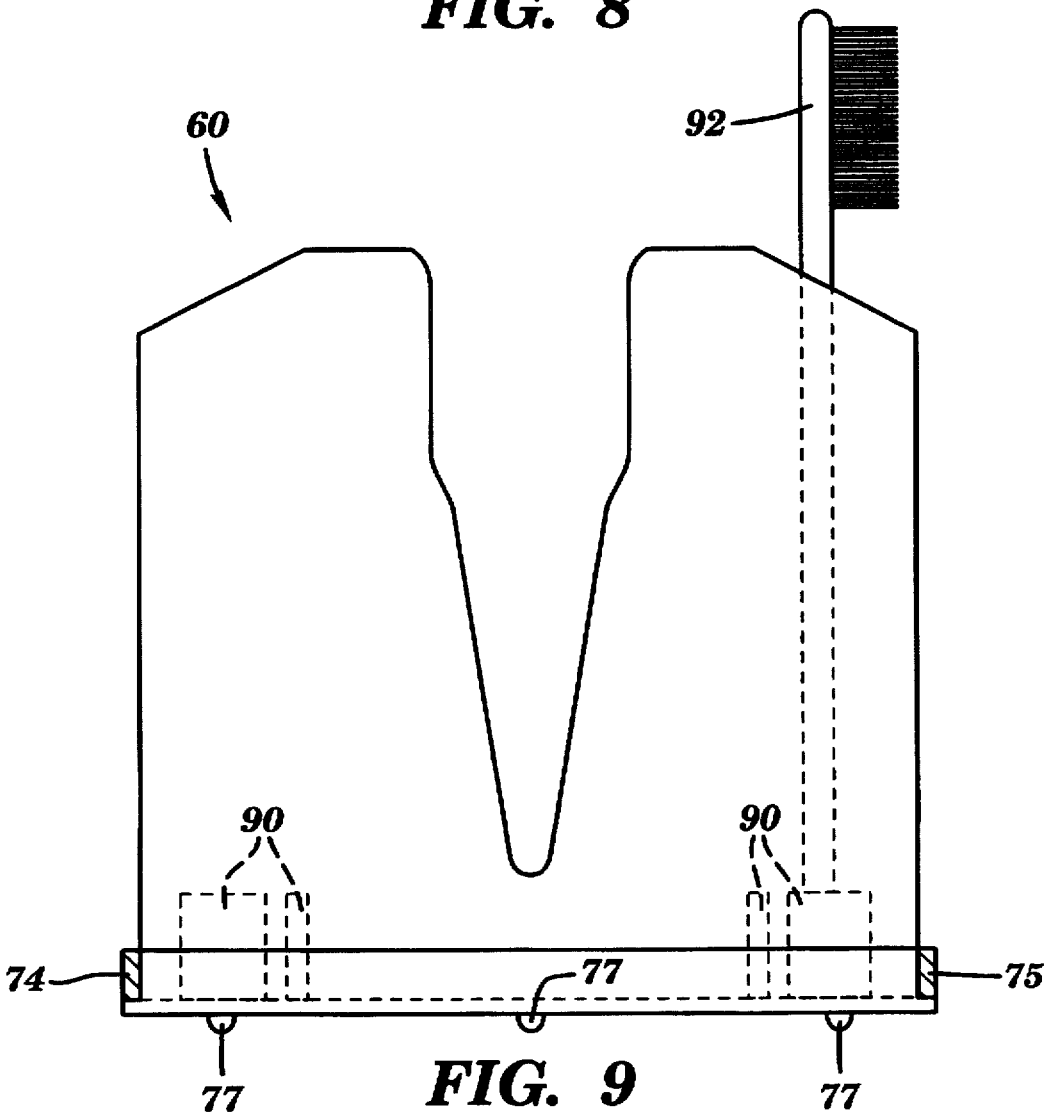
FIG. 9 is a front view of an alternate embodiment of the present invention.

Referring now to FIGS. 8–9, a further feature of the base tray 74 is shown. As shown in FIG. 8, vertical tabs 90 are attached to the top of base tray 74. As shown in FIG. 9, tabs 90 provide a positioning system for toothbrush 92. Thus, when toothbrush 92 is inserted into cavity 76 via receiving hole 72 (see FIG. 7), it remains in a generally upright position with the aid of tabs 90.

Base tray 74 also may include small "buttons" 77 on the bottom thereof. The buttons 77 prevent the holder 60 from sliding on a counter top. In particular, they allow water to evaporate so that mold is not grown thereunder.

Figure 10:
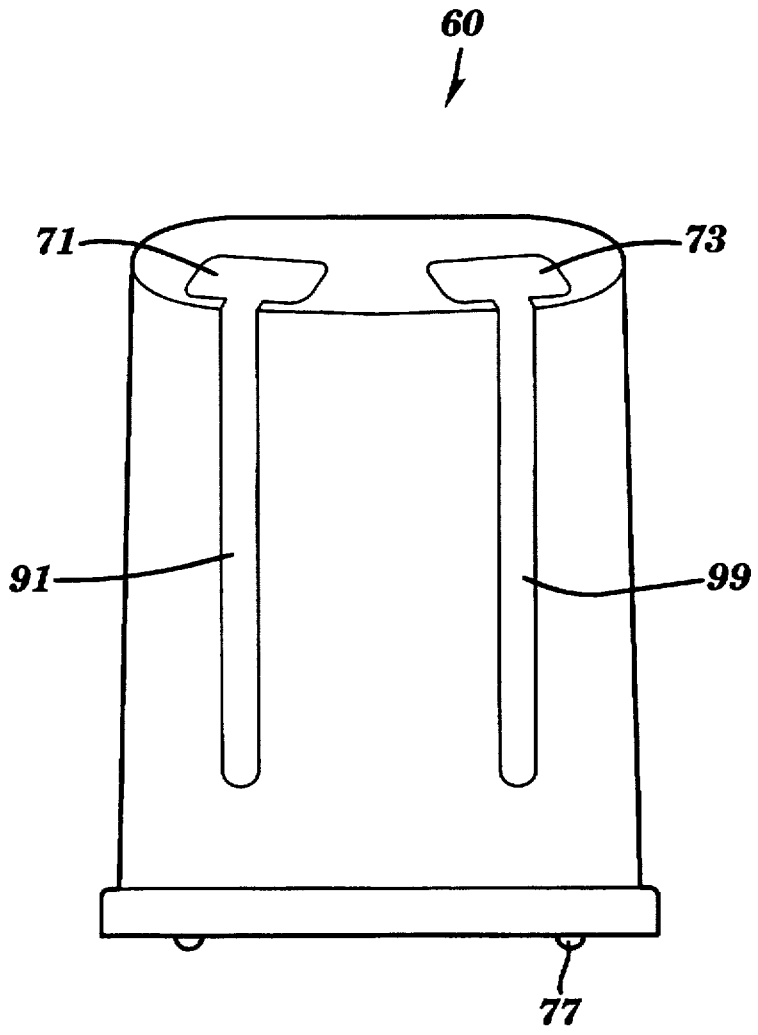
FIG. 10 is a side view of an alternate embodiment of the present invention.

Referring to FIG. 10, a side view of the toothbrush holder 60 is disclosed showing slots 91 and 99. The slots extend from the receiving holes 71 and 73 down the side of the holder 60. These slots 91 and 93 provide improved toothbrush access, particularly if the toothbrush contains an end pick or the like. In addition, the slots facilitate evaporation (e.g., increasing convective and radiative heat transfer).

The embodiments disclosed herein have been discussed for the purpose of familiarizing the reader with the novel aspects of the invention. Although preferred embodiments of the invention have been shown, many changes, modifications and substitutions may be made by one having ordinary skill in the art without necessarily departing from the spirit and scope of the invention as described in the following claims.

I claim:

1. A toothpaste tube and toothbrush holder comprising:

(a) a base; and (b) first and second opposing sections, attached to said base, said opposing sections rigidly fixed relative to one another and adapted for receiving a toothpaste container therebetween, each of said first and second sections including:

(1) an upper surface, wherein each of said upper surfaces includes a toothbrush receiving hole;

(2) an outer surface, wherein each of said outer surfaces includes a vertical slit extending from said toothbrush receiving hole down toward said base; and (3) an inner surface the inner surface having a plurality of shelves opposite said outer surface.

2. The toothpaste tube holder of claim 1 wherein each of said first and second opposing sections further comprise an enclosed receiving cavity, said receiving cavities located between said inner surface and said outer surface and accessible via said toothbrush receiving holes.

3. The toothpaste tube holder of claim 2 wherein said base comprises a removably attached base tray on the bottom of said holder thereby allowing additional access to said enclosed receiving cavities.

4. The toothpaste tube holder of claim 3 wherein said removably attached base tray comprise buttons on the bottom thereof.

5. The toothpaste holder of claim 3 wherein said base tray comprises vertical tabs for holding a toothbrush in place.

6. A toothpaste tube and toothbrush holder comprising:

(a) a base tray, wherein said base tray comprises vertical tabs spaced proximate one another for holding a toothbrush in place; and (b) first and second opposing sections, removably attachable to said base tray, said opposing sections rigidly fixed relative to one another and adapted for receiving a toothpaste container therebetween, each of said first and second sections including:

(1) an upper surface having at least one toothbrush support, (2) an outer surface, and (3) an inner surface opposite said outer surface, the inner surface having a plurality of shelves.

7. A toothpaste tube and toothbrush holder comprising:

(a) a base including a base tray; and (b) first and second opposing sections, removably attachable to said base tray, said opposing sections, rigidly fixed relative to one another and adapted for receiving a toothpaste container therebetween, each of said first and second sections including:

(1) an upper surface, wherein said upper surface includes a plurality of toothbrush receiving holes, (2) an outer surface, wherein said outer surface comprises a vertical slit extending from said receiving holes down toward said base, (3) an inner surface opposite said outer surface, the inner surface having a plurality of shelves, and (4) a receiving cavity located between said inner and outer surface and accessible via said toothbrush receiving holes.

* * * * *